US007464656B2

(12) United States Patent
Garin et al.

(10) Patent No.: US 7,464,656 B2
(45) Date of Patent: Dec. 16, 2008

(54) ATTACHMENT DEVICE RELEASABLE UNDER A LOAD FOR A TRAPEZE HARNESS USED IN SAILING

(75) Inventors: Arnaud Garin, La Chapelle sur Erdre (FR); Florence Lebrun, Quiberon (FR); Philippe Delhaye, Saint Quiberon (FR)

(73) Assignees: Wichard (FR); Ecole Nationale de Voile (FR)

( * ) Notice: Subject to any disclaimer, the term of this patent is extended or adjusted under 35 U.S.C. 154(b) by 0 days.

(21) Appl. No.: 11/578,808

(22) PCT Filed: Apr. 12, 2005

(86) PCT No.: PCT/FR2005/000883

§ 371 (c)(1),
(2), (4) Date: Jun. 22, 2007

(87) PCT Pub. No.: WO2005/110841

PCT Pub. Date: Nov. 24, 2005

(65) Prior Publication Data

US 2007/0289515 A1 Dec. 20, 2007

(30) Foreign Application Priority Data

Apr. 23, 2004 (FR) ..... 04 04345

(51) Int. Cl.
*B63H 9/00* (2006.01)

(52) U.S. Cl. ..... 114/39.18

(58) Field of Classification Search ..... 114/39.18
See application file for complete search history.

(56) References Cited

U.S. PATENT DOCUMENTS 3,831,229 A * 8/1974 Craven ..... 294/82.25
4,378,614 A * 4/1983 McKenney ..... 441/75
4,452,161 A * 6/1984 McCoy ..... 114/39.18
6,640,397 B1 11/2003 Gipson

FOREIGN PATENT DOCUMENTS

DE 33 16 583 11/1984

OTHER PUBLICATIONS

International Search Report; PCT/FR2005/000883; Sep. 14, 2005 (all references in search report listed above).

* cited by examiner

*Primary Examiner*—Stephen Avila
(74) *Attorney, Agent, or Firm*—Cantor Colburn LLP

(57) ABSTRACT

The device includes a planar body (3) secured to a harness bar (2), a hook (10) pivotably mounted on the front portion of the body (3) about a pin (9) transversal to the body, wherein said hook comprises a pointed end (13) on the rear side thereof, a hairpin spring (15) with the facing ends of the branches thereof engaged in apertures (16) of the body that are offset so as to rotate the entire spring unit forwards, and such that the central portion of the spring (15) locks the hook (10) by engaging same at the rear of the pointed end (13) thereof, and a lever (11), hinged to the body (3) about a pin (17) parallel to the pin (9) of the hook (10) and located above same, comprising an upper portion (18), above the pin (17), facing upwards and forwards and a lower portion (19) facing downwards and rearwards, the lower end of which engages the forward-facing surface of the branches of the hairpin spring (15).

5 Claims, 3 Drawing Sheets

ATTACHMENT DEVICE RELEASABLE UNDER A LOAD FOR A TRAPEZE HARNESS USED IN SAILING

BACKGROUND OF THE INVENTION

The present invention relates to an attachment device releasable under load for a trapeze harness used in sailing, particularly in sailing light craft.

DESCRIPTION OF THE PRIOR ART

To increase the righting moment of the crew of one or more persons, in order to make the trim of a dinghy, a sport catamaran, or a sailboard as level as possible in a strengthening wind, the helmsman and the crew member or members use what is known as a trapeze. For this purpose, the crew member or each crew member is provided with a harness having a hook located at the level of the abdomen. This hook allows the passage of a metal loop fixed to one end of a cable whose other end is fixed to the mast, in the case of a sailing craft.

If no tension is applied to the hook, the loop fixed to the cable can easily escape from the hook, enabling the crew member to be released for necessary maneuvers, particularly for changing sides. However, if the cable remains under tension, or if the hook is attached to an accessory other than the loop, the crew member may be unable to detach himself from the loop, and may be placed in a difficult situation. Accidents which are infrequent but may be fatal can occur, regardless of the level of skill of the practitioners. These accidents often occur when boats capsize and crew members fall into the water. In this case, crew members can be trapped under the boat or under the sails and may be unable to free themselves, because they are held by the tension of the trapeze cable which prevents the release of the hook. In other cases, a crew member falling from the boat may be suspended by the hook from a rope in tension in the boat. This accessory may be the downhaul in the case of a dinghy, or the trampoline lacing in the case of a catamaran. Regardless of the situation, the common feature is that the crew member only has a very short time to free himself before being trapped under the vessel, and his body weight often contributes to the capsizing of the vessel.

Hazardous situations are becoming increasingly common at the present time, since there is an increasing number of vessels which are becoming faster and less stable, and which require the use of the trapeze for the crew member or members and also for the helmsman, in solo or two-main sailing.

Some accidents have led sailing clubs to dispense with the use of trapeze harnesses in certain wind and sea conditions, to prevent accidents, even if the conditions are those in which this type of equipment is most useful.

SUMMARY OF THE INVENTION

The invention provides an attachment device releasable under load for a trapeze harness, by means of which a crew member wearing such a harness can free himself immediately, by a reflex action, even if the hook exerts a tension on the cable tied to the mast or to another accessory belonging to the structure of the vessel.

For this purpose, the device to which the invention relates comprises:

a planar body secured to a harness bar, receiving a set of straps which the crew member can put on with the harness bar against his abdomen, the body being positioned in the longitudinal median plane of the bar and facing forward, a hook mounted pivotably on the front portion of the body about a pin transverse to the body, this hook having, under its pivot pin, on one hand, a curved portion on the front face in the form of a hook open downward and, on the other hand, a point on the rear face having a depression opening downward, a hairpin spring of which the two ends of the branches, facing each other, are engaged in apertures of the body that are offset and thus tend to make the spring assembly pivot forward, in such a way that the central part of the spring locks the hook by bearing on the depression of the point of the hook, and a lever hinged to the body about a pin parallel to the pin of the hook and located above the latter, having an upper portion above the pin facing upward and forward and a lower portion facing downward and rearward, whose lower end bears on the forward facing surface of the branches of the hairpin spring.

Since the hook is open downward, a crew member provided with a harness incorporating this device can attach himself rapidly by engaging the hook on a loop or similar secured to a cable fixed to the mast. In the locked position of the hook, the hook is kept in its locked position by the central portion of the hairpin spring which bears on the point forming the rear part of the hook.

If the crew member provided with this trapeze harness wishes to release the hook under load, he exerts a forward pressure on the upper portion of the hinged lever, the lower part of the lever causing the lower portion of the hairpin spring to swing about the hinge points of this spring, in such a way that the spring releases the point of the rear portion of the hook which can thus pivot freely about its pivot pin on the body.

Advantageously, the hook pivot pin is mounted transversely in a cylindrical part, which itself is mounted pivotably in the body about an axis orthogonal to the pivot pin of the hook.

This characteristic makes it possible, after the disengagement of the point of the rear portion of the hook from the hairpin spring, for the hook assembly to pivot about an axis transverse to the axis of rotation of the hook on the body. Thus there is a double rotation, similar to that of a universal joint, which considerably improves safety since it enables the hook to be released from the attachment loop regardless of the orientation of the cable exerting tension on the hook.

According to a useful characteristic of the invention, the lower face of the body has a U-section opening downward, into which the hook is inserted in its locked position by the spring.

Thus, in the locked position, the hook is held by the lower portion of the body, and therefore cannot pivot about the axis orthogonal to the main axis of rotation of the hook.

In one embodiment of this device, the body takes the general shape of a C opening forward, between whose branches is mounted a support for pivoting the hook.

Advantageously, the lever pin is mounted in an elongate aperture formed in the body and oriented vertically and from the front to the back, a depression formed in the lower portion of the body being positioned substantially in the extension of this aperture, the lower end of the lever being designed to be engaged in this depression when the hook is in the open position and when the spring is in the retracted position.

Thus, when the crew member pushes on the release lever, this lever pivots about its axis of rotation, and at the same time the axis of rotation is shifted downward in the aperture, until the lever occupies a locked position, in which its lower end is placed in the depression formed in the lower portion of the body. In this position, the lever therefore keeps the spring in the open position, and does not allow the point of the rear portion of the hook and the spring to re-engage. Thus the hook cannot be moved accidentally toward its locked position. To relock the hook, the user must perform a voluntary action consisting in swinging the hook toward its locked position, then moving the lever forward and upward to release the spring and allow the latter to engage behind the point of the rear portion of the hook.

The invention will be clearly understood with the aid of the following description, which refers to the attached schematic drawing which represents by way of example and without restrictive intent an embodiment of this attachment device for a trapeze harness.

DESCRIPTION OF THE PREFERRED EMBODIMENT

Figure 1:
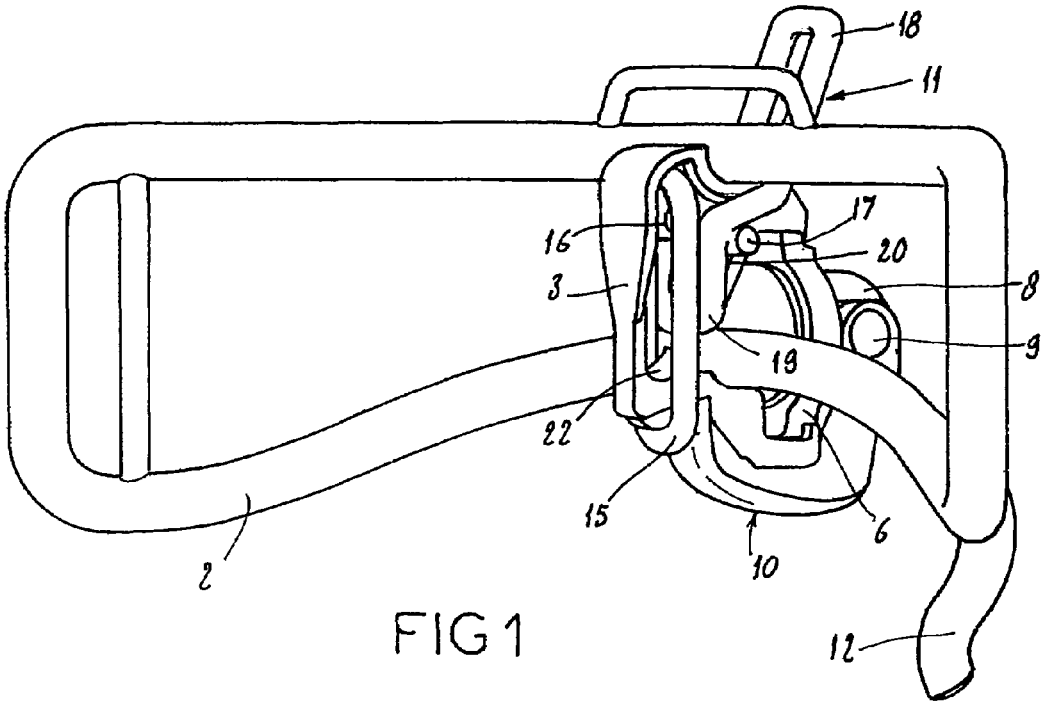
FIG. 1 is a three-quarter perspective view from the rear of this device in the locked position.
Figure 4:
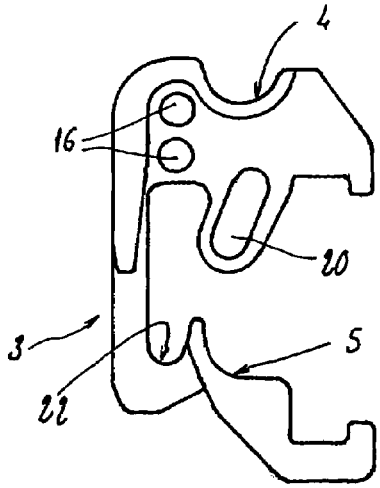
FIG. 4 is a side view of the body of the attachment device.

The attachment device shown in the drawing comprises a harness bar 2 consisting of a tubular structure, intended to receive a set of straps (not shown) enabling a crew member to equip himself with the harness bar positioned on his abdomen.

A planar body 3, in the form of a C-section part opening forward, is fixed on this harness bar and is positioned in the longitudinal median plane of the bar. The body is fixed to the harness bar by engaging two tubular elements, namely the upper and lower elements of the bar, in two depressions 4 and 5 respectively of the body.

The front end of the body is provided with a support 6 which closes the opening of the C, this support 6 having a central aperture 7 with a circular cross section, facing forward. This aperture 7 with a circular cross section is used for the pivoting mounting of a cylindrical part 8. A part 10 forming a hook is mounted pivotably on the front portion of this part 8 about a pin 9 orthogonal to the axis around which the part 8 can pivot with respect to the support 9. This part 10 is hinged with the aid of a shackle whose two wings are engaged with the cylindrical part 8, and are associated with the latter by the pin 9. The part 10 which forms a hook has, below the hinge pin and at its front end, a curved part 12 opening downward and used for attachment to a loop secured to a cable belonging to the vessel. This part 10 has on its rear end a point 13 having a depression 14 facing downward.

On the rear portion of the body 3 there is mounted a hairpin spring 15, of which the two ends of the branches, facing toward each other, are engaged in apertures 16 offset with respect to each other and formed in the body, this offset tending to make the spring assembly pivot forward. Thus, when the hook 10 is in the locked position, the central portion of the spring 15 surrounds the point 13 of the hook 10, and bears on the depression 14 of this point.

This attachment device also comprises a lever 11 mounted pivotably on the body 3 about a pin 17. This lever has an upper portion 18 located above the pin 17, facing upward and forward, and a lower portion 19, facing downward and rearward, whose lower end bears on the forward-facing surface of the branches of the hairpin spring 15.

The pin 17 is mounted pivotably in an elongate aperture 20 of the body, this aperture being oriented vertically and from the front to the back. An upward-facing depression 22 is formed in the body, substantially in the extension of this aperture, and the lower end 19 of the lever is designed to engage in this depression when the pin 17 of the lever is in the lower position in the aperture 20.

The operation of this attachment device is as follows.

Figure 2:
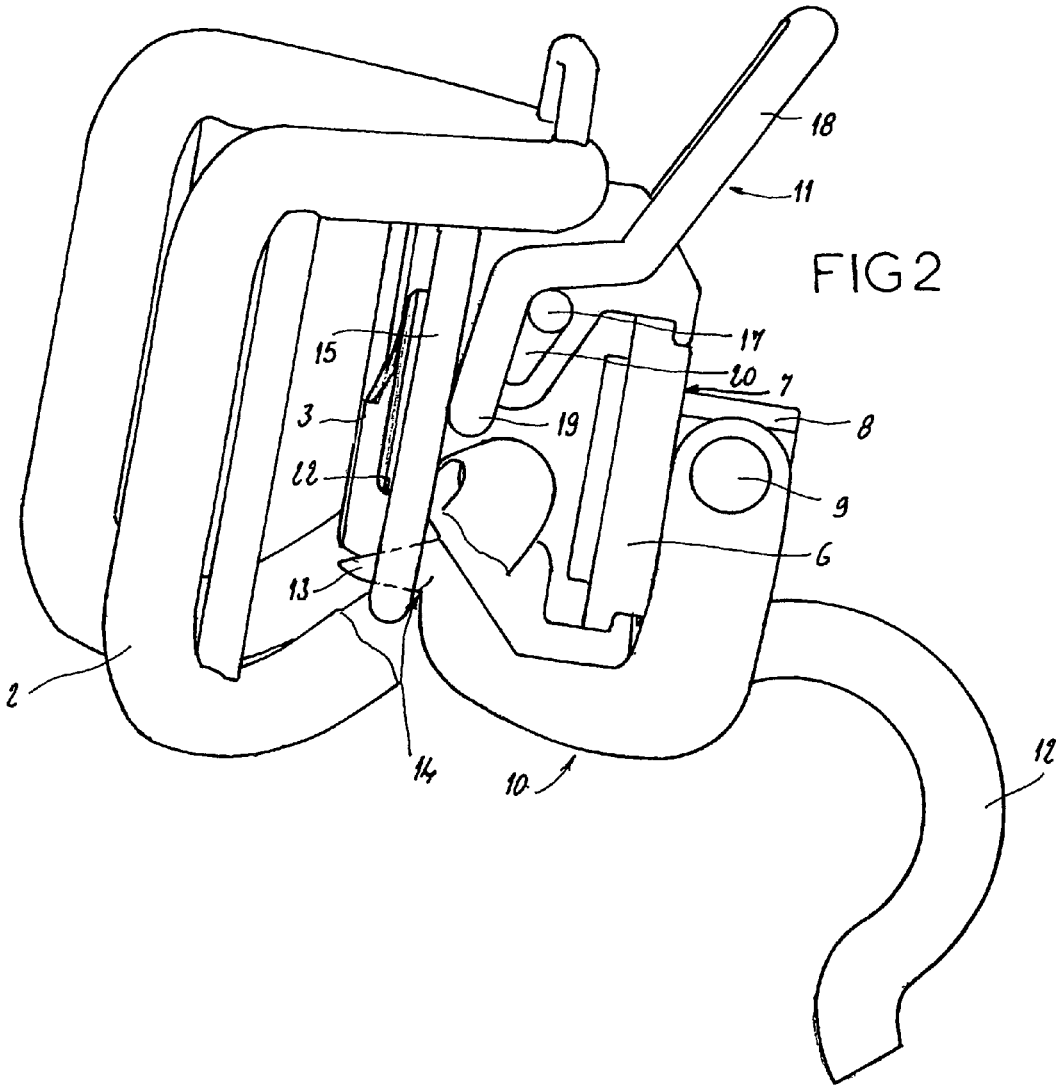
FIGS. 2 and 3 are two side views of this device, in the locked position and in the unlocked position respectively.
Figure 3:
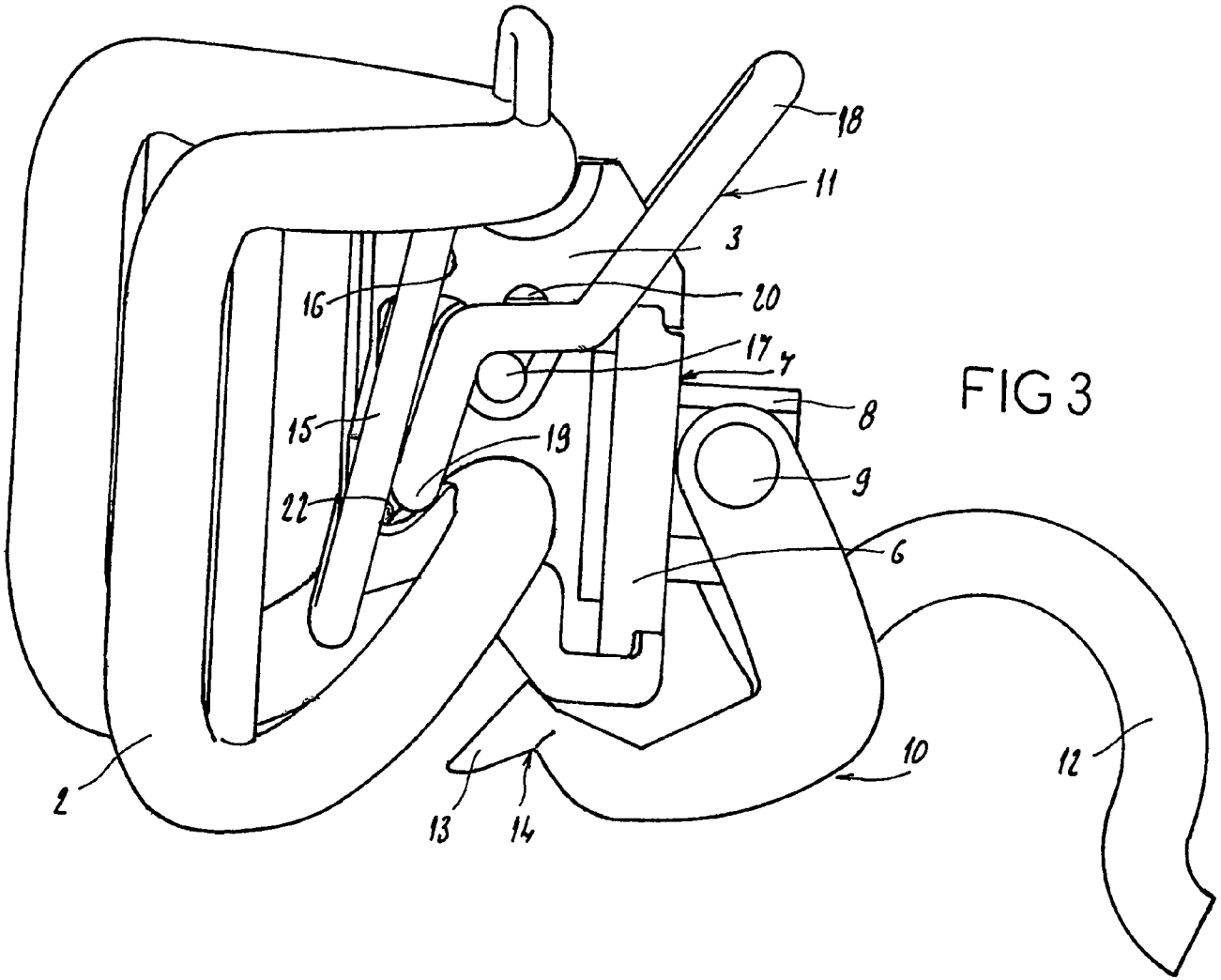

In the position shown in FIGS. 1 and 2, the device is in the locked position. A crew member whose trapeze harness is provided with this device can attach the curved part 12 of the hook 10 to a loop secured to a cable fixed to the mast of the vessel, by engaging the loop behind the curved portion of the hook. The tension exerted on the cable by the hook keeps the latter in the loop.

If it is necessary to release the device while the hook is pulling on the cable, the crew member exerts pressure from the front to the rear on the upper portion 18 of the lever 11. This action causes the lever assembly 11 to pivot about the pin 17, and causes the pin 17 to move from the upper portion of the aperture 20 toward its lower portion. During this movement, the spring 15 pivots in such a way that its central part releases the point 13 of the hook 10, the lower portion 19 of the lever becoming engaged in the depression 22 of the body to keep the spring in the release position. The hook 10 begins to swing about the pin 9, and its central part, escaping from the U-shaped portion of the body, allows pivoting about the axis of the cylindrical part 8, this axis being orthogonal to the pivot axis 9 of the hook on the same part. Thus the curved portion 12 of the hook 10 can escape from the loop of the cable, or from any other accessory of the vessel on which this curved portion exerts a tension.

To return the device to the locked position, the hook 10 has to be pivoted toward its locked position, after which the lever 11 is operated to move it upward, the pin 17 being moved toward the upper portion of the aperture 20 in order to release the spring 15 which, under the effect of its elasticity, surrounds the point 13 and keeps the hook in the locked position, as shown in FIGS. 1 and 2.

As the above description indicates, the invention greatly improves the prior art, by providing a device with a simple structure which can be operated instantaneously by a crew member, even in very difficult conditions, and which allows the hook to be released regardless of the direction of application of the force on the curved portion of the hook.

Clearly, the invention is not limited to the single embodiment of this device described above by way of example, but includes all variants of this. Thus, for example, the hook 10 could pivot about a single pin on the body, or the opening lever could be mounted pivotably about a pin which is fixed with respect to the body, without any departure from the scope of the invention.

The invention claimed is:

1. An attachment device releasable under load for a trapeze harness used in sailing, which comprises:

a planar body secured to a harness bar, receiving a set of straps which a crew member can put on with the harness bar against his abdomen, the body being positioned in a longitudinal median plane of the bar and facing forward, a hook mounted pivotably on a front portion of the body about a pivot pin transverse to the body, this hook including a downwardly hooked curved portion on a front face under the pivot pin, and a depression on the rear face that opens downward, a hairpin spring of which two ends of branches, facing each other, are engaged in apertures of the body that are offset and thus tend to make the spring pivot forward, in such a way that a central part of the spring locks the hook by bearing on a depression of the point of the hook, and a lever hinged to the body about a pin parallel to the pin of the hook and located above the latter, having an upper portion above the pin facing upward and forward and a lower portion facing downward and rearward, whose lower end bears on a forward facing surface of the branches of the hairpin spring.

2. The device as claimed in claim 1, wherein the pivot pin of the hook is mounted transversely in a cylindrical part, which itself is mounted pivotably in the body about an axis orthogonal to the pivot pin of the hook.

3. The device as claimed in claim 2, wherein a lower face of the body has a U-section opening downward, into which the hook is inserted in its locked position by the spring.

4. The device as claimed claim 1, wherein the body is in the general shape of a C opening forward, between whose branches is mounted a support for the pivoting of the hook.

5. The device as claimed in claim 1, wherein the pin of the lever is mounted in an elongate aperture formed in the body and oriented vertically and from a front to a back, a depression formed in the lower portion of the body being positioned substantially in an extension of this aperture, a lower end of the lever being designed to be engaged in this depression when the hook is in an open position and when the spring is in a retracted position.

* * * * *